US008701795B2

(12) United States Patent
Menger et al.

(10) Patent No.: US 8,701,795 B2
(45) Date of Patent: Apr. 22, 2014

(54) ADJUSTABLE ROTARY STEERABLE SYSTEM

(75) Inventors: Christian Menger, Recke (DE); Michael Pearce, Cheltenham (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 491 days.

(21) Appl. No.: 13/172,265

(22) Filed: Jun. 29, 2011

(65) Prior Publication Data

US 2013/0000984 A1 Jan. 3, 2013

(51) Int. Cl.
*E21B 7/08* (2006.01)

(52) U.S. Cl.
USPC ..... 175/61; 175/73; 175/74

(58) Field of Classification Search
USPC ..... 175/73, 74, 76, 256, 61
See application file for complete search history.

(56) References Cited

U.S. PATENT DOCUMENTS

| | | | | |
|---|---|---|---|---|
| 5,074,366 | A * | 12/1991 | Karlsson et al. | 175/76 |
| 5,343,967 | A * | 9/1994 | Kruger et al. | 175/75 |
| 6,843,332 | B2 * | 1/2005 | Eppink et al. | 175/73 |
| 8,360,172 | B2 * | 1/2013 | Santelmann | 175/61 |
| 8,590,636 | B2 * | 11/2013 | Menger | 175/61 |

* cited by examiner

*Primary Examiner* — Giovanna Wright
(74) *Attorney, Agent, or Firm* — Chadwick A. Sullivan; Brigitte Echols

(57) ABSTRACT

A technique facilitates the drilling of deviated wellbores. A steerable drilling system is formed with a pair of components pivotably mounted with respect to each other. A removable strike ring is mounted to one of the steerable drilling system components and is positioned to engage a corresponding strike ring in a manner which limits the maximum pivot angle between the steerable drilling system components. By interchanging the removable strike ring with other removable strike rings, the maximum pivot angle can be adjusted in the field to accommodate drilling of a wider variety of deviated wellbores.

20 Claims, 2 Drawing Sheets

ADJUSTABLE ROTARY STEERABLE SYSTEM

BACKGROUND

Oil and gas reservoirs may be accessed by drilling wellbores to enable production of hydrocarbon fluid, e.g. oil and/or gas, to a surface location. In many environments, directional drilling techniques have been employed to gain better access to the desired reservoirs by forming deviated wellbores as opposed to traditional vertical wellbores. However, forming deviated wellbore sections can be difficult and requires directional control over the orientation of the drill bit used to drill the deviated wellbore.

Rotary steerable drilling systems have been used to drill deviated wellbore sections while enabling control over the drilling directions. Such drilling systems often are classified as push-the-bit systems or point-the-bit systems and allow an operator to change the orientation of the drill bit and thus the direction of the wellbore. In conventional rotary steerable drilling systems, the wellbore deviation or dogleg capability is limited by the interaction of pivotable components within the rotary steerable drilling system. As a result, the dogleg capability is not sufficiently adjustable while in the field.

SUMMARY

In general, a system and methodology is provided to facilitate the drilling of deviated wellbores. A steerable drilling system is formed with a pair of components pivotably mounted with respect to each other. A removable strike ring is mounted to one of the steerable drilling system components and is positioned to engage a corresponding strike ring in a manner which limits the maximum pivot angle between the steerable drilling system components. By interchanging the removable strike ring with other removable strike rings, the maximum pivot angle can be adjusted in the field to accommodate drilling of a wider variety of deviated wellbore sections.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

The embodiments described herein generally relate to a system and method for facilitating the drilling of a deviated wellbore. A drilling system comprises an adjustable, steerable drilling system, e.g. an adjustable, rotary steerable system, which provides control over the dogleg capability of the steerable system. Furthermore, the dogleg capability is readily adjustable while in the field. Removable strike rings may be interchanged in the field to provide different steering offsets between the pivotable components of the steerable drilling system. For example, different strike rings may be mounted to the steerable drilling system to increase or decrease the pivot limit between the pivotable components.

Figure 1:
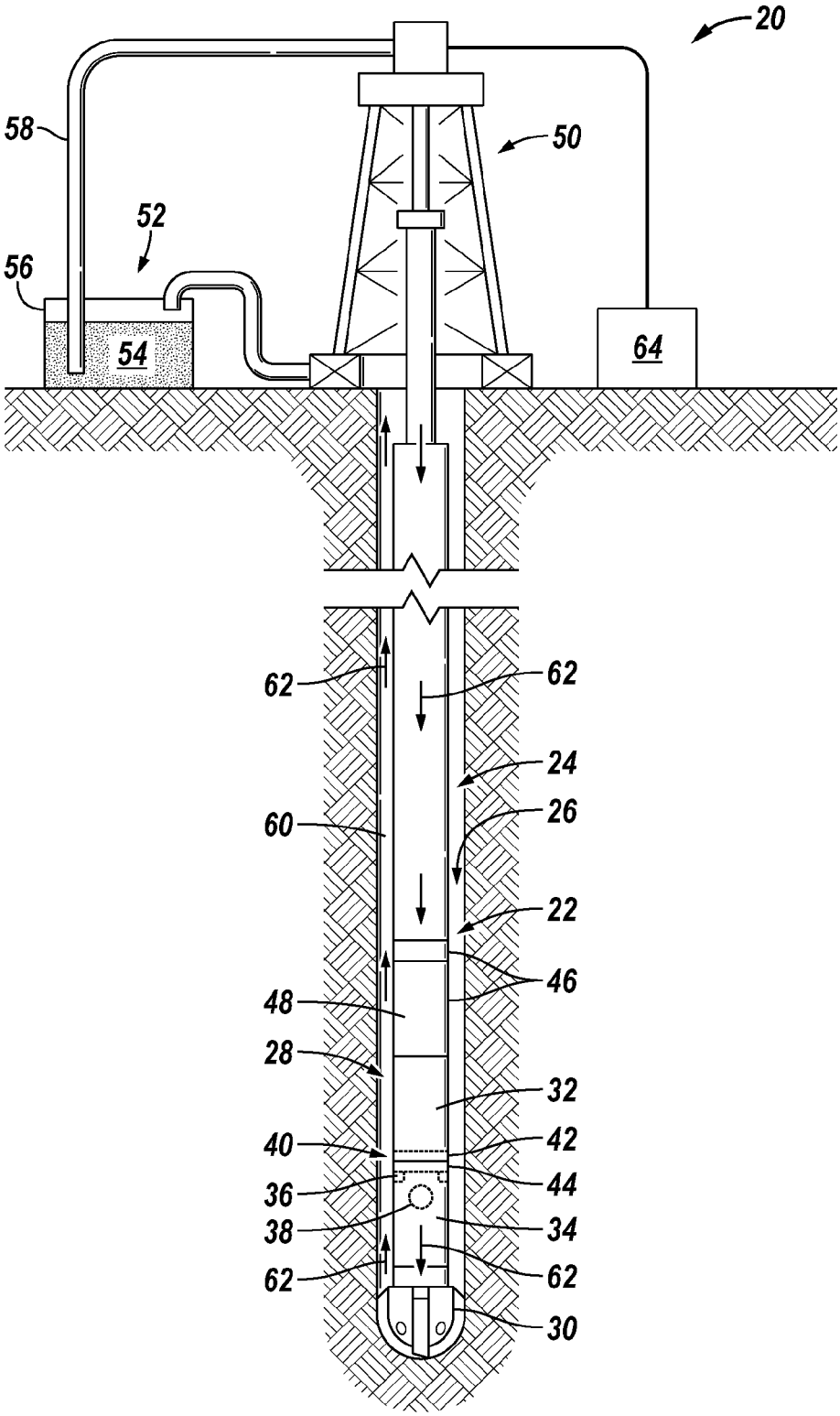
FIG. 1 is a schematic illustration of an example of a drill string which includes an adjustable, steerable drilling system, according to an embodiment of the present invention.

Referring generally to FIG. 1, an embodiment of a drilling system 20 is illustrated as having a bottom hole assembly 22 which is part of a drill string 24 used to form a desired, directionally drilled wellbore 26. The illustrated bottom hole assembly 22 of drilling system 20 comprises a steerable drilling assembly 28, e.g. a rotary steerable system, which controls the drilling orientation of a drill bit 30. The steerable drilling assembly 28 comprises steerable system components 32, 34 which pivot with respect to each other to enable the desired directional drilling during formation of wellbore 26. Steering actuators 36 may be mounted between components 32 and 34 to control the pivoting of component 34 with respect to component 32 by providing the desired lateral forces for steering the steerable drilling assembly 28 when forming the desired, deviated wellbore 26. Additionally, steerable system components 32, 34 may be coupled together by a pivot joint 38, such as a universal joint.

Steerable drilling assembly 28 also may comprise a pivot control or steering offset control system 40 which is designed to provide the desired steering offset by limiting the pivot angle between components 32 and 34. The steering offset is limited by contact between components, and this steering offset can be controlled, e.g. changed, at the well site by interchanging removable components. The interchangeable components have varying offsets to provide the steerable drilling assembly 28 with a specific dogleg capability for a specific steering assembly and/or drilling application.

By way of example, the pivot control system 40 comprises a removable strike ring 42 which is mounted to one of the steerable drilling assembly components 32 or 34. The removable strike ring 42 is positioned to engage a corresponding strike ring 44 mounted on the other of the components 32 or 34. The removable strike ring 42 is readily removable and interchanged with another strike ring 42 having a different steering offset. Changing the steering offset provides a different maximum pivot angle between components 32 and 34 and thus a different dogleg capability.

Depending on the environment and the operational parameters of the drilling job, drilling system 20 may comprise a variety of other features. For example, drill string 24 may include drill collars 46 which, in turn, may be designed to incorporate desired drilling modules, such as logging-while-drilling and/or measurement-while-drilling modules 48. In some applications, stabilizers may be used along the drill string to stabilize the drill string with respect to the surrounding wellbore wall.

Various surface systems also may form a part of the drilling system 20. In the example illustrated, a drilling rig 50 is positioned above the wellbore 26 and a drilling mud system 52 is used in cooperation with the drilling rig. For example, the drilling mud system 52 may be positioned to deliver drilling fluid 54 from a drilling fluid tank 56. The drilling fluid 54 is pumped through appropriate tubing 58 and delivered down through drilling rig 50, into drill string 24, and down through drill bit 30. In many applications, the return flow of drilling fluid flows back up to the surface through an annulus 60 between the drill string 24 and the surrounding wellbore wall (see arrows 62 showing flow down through drill string 24 and up through annulus 60). The drilling system 20 also may comprise a surface control system 64 which may be used to communicate with steerable drilling assembly 28. In some embodiments, the surface control system 64 communicates with a downhole steering control system within steerable drilling assembly 28.

Figure 2:
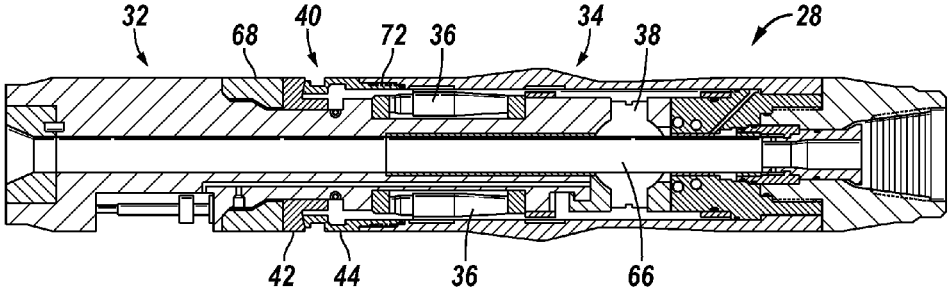
FIG. 2 is a cross-sectional view of an example of an adjustable rotary steerable system, according to an embodiment of the present invention.

Referring generally to FIG. 2, an example of steerable drilling assembly 28 is illustrated. In this embodiment, steerable drilling assembly 28 is in the form of a rotary steerable system which utilizes steering actuators 36 to control the relative angular orientation between steering components 32 and 34. The steering components 32 and 34 are pivotably coupled to each other via pivot joint 38 which, in this particular example, is in the form of a universal joint. Additionally, a drilling fluid flow passage 66 extends through steering components 32, 34 to conduct the flow of drilling fluid through rotary steerable system 28, as indicated by arrows 62 along drill string 24 in FIG. 1.

In the example illustrated in FIG. 2, the pivot and offset control system 40 comprises removable strike ring 42 which is located for engagement with corresponding strike ring 44 when steering component 34 is pivoted to a maximum angle relative to steering component 32. In other words, engagement of removable strike ring 42 with corresponding strike ring 44 limits the maximum pivot angle between components 32, 34. In some embodiments, a spacer ring 68 may be used to locate and/or secure the removable strike ring 42 at a desired position for engagement with corresponding strike ring 44.

Figure 3:
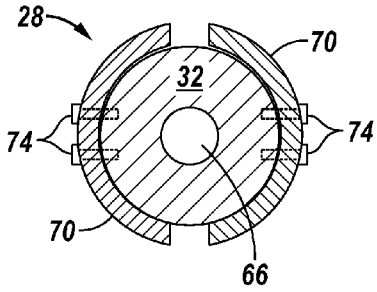
FIG. 3 is a schematic view of an example of a removable strike ring employed in the adjustable rotary steerable system, according to an embodiment of the present invention.

By way of further example, removable strike ring 42 may comprise a split strike ring having separate or split components 70, as illustrated best in FIG. 3. The components 70 of the split strike ring 42 are independently secured to one of the steering components 32 or 34. In the embodiment illustrated in FIGS. 2 and 3, for example, the split strike ring 42 is removably mounted to steering component 32, and corresponding strike ring 44 is mounted to component 34 by a suitable fastener 72, e.g. a threaded engagement. However, the removable strike ring 42 can be mounted to component 34, while the corresponding strike ring 44 is mounted to component 32.

Additionally, the separate components 70 may be individually attached to and removed from the steering component, e.g. steering component 32, via suitable fasteners 74. By way of example, fasteners 74 may comprise bolts in which one or more bolts extends through each component 70 for threaded engagement with the underlying steering component, e.g. steering component 32. The bolts or other suitable fasteners 74 are readily removed while in the field to enable interchanging of removable strike ring 42 with another removable strike ring 42 having a different steering offsets. If spacer ring 68 is employed to position removable strike ring 42, the spacer ring 68 also may be removably secured to the steering component via similar fasteners 74.

Figure 4:
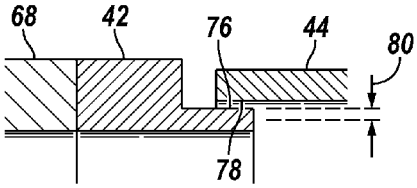
FIG. 4 is a schematic illustration of a removable strike ring interacting with a corresponding strike ring to limit a pivot angle of the adjustable rotary steerable system, according to an embodiment of the present invention.

The steering offset, and thus the maximum pivot angle between components 32 and 34, can be controlled by changing the diameter and/or angle of an abutment region 76 of removable strike ring 42, as illustrated in FIG. 4. The removable strike ring 42 is positioned so that abutment region 76 abuts and stops against a corresponding abutment region 78 of corresponding strike ring 44. In the specific example illustrated, corresponding strike ring 44 is an outer strike ring which locates the corresponding abutment region 78 radially outward of abutment region 76 on removable strike ring 42. In some embodiments, removable strike ring 42 is in the form of the split strike ring having independent strike ring components 70 which are positioned by spacer ring 68. However, other types of removable strike rings may be utilized with abutment regions radially inward and/or radially outward of the corresponding strike ring 44 to limit relative pivotable motion between steering components 32 and 34.

By interchanging the removable strike ring 42 with another removable strike ring, the steering offset can be changed as represented by arrows 80. In the example illustrated, different removable strike rings have different diameters at abutment region 76 thereby providing different steering offsets and thus different maximum pivot angles. Selecting removable strike rings having smaller or larger diameters at abutment region 76 increases and decreases, respectively, the maximum pivot angle allowed between steering components 32 and 34.

Figure 5:
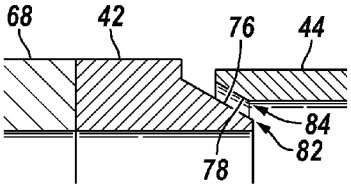
FIG. 5 is a schematic illustration of an alternate removable strike ring interacting with a corresponding strike ring to limit a pivot angle of the adjustable rotary steerable system, according to an embodiment of the present invention.

Abutment region 76 and corresponding abutment region 78 may have a variety of sizes and configurations depending on the desired design and function of the rotary steerable system 28. As illustrated in the alternate embodiment of FIG. 5, for example, the abutment regions 76, 78 may be angled to create tapered sections 82, 84, respectively. The steering offset can thus be controlled by changing the angle and/or diameter of the tapered section 82 of removable strike ring 42. If the strike ring 42 is constructed as a split strike ring with removable portions 70, each removable portion 70 can be formed with the appropriate tapered section 82. Detaching the removable portion 70 and substituting other removable portions having different angles and/or diameters effectively changes the steering offset. Changing the steering offset changes the maximum relative pivot angle between steering system components 32 and 34 when the steering system components are pivoted with respect to each other about joint 38. This, in turn, changes the dogleg capability of the drilling system to facilitate drilling of desired, deviated wellbores, as discussed above.

While in the field, e.g. at a well site, the removable strike ring 42 is readily interchanged with other strike rings by removing fasteners 74 and then attaching another strike ring 42 having an abutment region 76 with a different diameter and/or angle. If spacer ring 68 is used to position the removable strike ring 42, the spacer ring 68 is initially detached (or at least sufficiently loosened) to enable removal of portions 70 of removable, split strike ring 42. It should be noted, however, that removable strike ring 42 may have a variety of configurations. For example, the removable strike ring 42 may comprise components which are hinged together or otherwise coupled together by a flexible connector. Additionally, the removable strike ring 42 may be constructed with components which are selectively fastened to each other about the desired steering component 32 or 34. In some applications, both the strike ring 42 and the corresponding strike ring 44 can be constructed as removable strike rings.

Depending on the specific drilling application and environment, the overall well drilling system 20 and steerable drilling assembly 28 may be designed according to a variety of configurations with many types of components. The actual configuration and components of the drilling system depend on the type of lateral wellbore desired and the size, shape, and other characteristics of the reservoir being produced. For example, the steerable drilling assembly 28 may comprise a push-the-bit system, a point-the-bit system, a hybrid steering system, or other types of controllable steering systems to facilitate drilling of deviated wellbores. The steerable drilling assembly 28 may have a variety of components and features in addition to the components and features described above. Furthermore, the drill string 24 also may be constructed in a variety of lengths, sizes and configurations with many types of components selected according to environmental parameters and other parameters of a given drilling operation.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A system for drilling a deviated wellbore, comprising:

a rotary steerable system comprising:

a pair of rotary steerable system components pivotably mounted to each other via a universal joint;

an outer strike ring mounted to one of the rotary steerable system components; and a split strike ring removably mounted to the other of the rotary steerable system components at a position to engage the outer strike ring in a manner which limits the maximum pivot angle between the rotary steerable system components to control dogleg capability during drilling, wherein the split strike ring is interchangeable in the field to adjust the maximum pivot angle.

2. The system as recited in claim 1, wherein the split strike ring is formed by a plurality of split strike ring portions which are individually secured to the other of the rotary steerable system components.

3. The system as recited in claim 2, wherein the plurality of split ring portions is secured by fasteners.

4. The system as recited in claim 2, wherein the plurality of split ring portions is secured by a spacer ring.

5. The system as recited in claim 2, wherein the plurality of split ring portions is secured by fasteners and a spacer ring.

6. The system as recited in claim 1, wherein the split strike ring has an abutment region of a predetermined angle and diameter to engage the outer strike ring upon pivoting of the pair of rotary steerable system components to their maximum dogleg angle.

7. The system as recited in claim 1, further comprising a drill bit mounted to the rotary steerable system.

8. The system as recited in claim 7, wherein the rotary steerable system comprises a drilling fluid passage through the pair of rotary steerable system components to deliver drilling fluid to the drill bit.

9. The system as recited in claim 1, wherein the rotary steerable system is coupled into a drill string.

10. A method, comprising:

pivotably coupling a pair of rotary steerable system components to facilitate directional drilling capability of a rotary steerable system;

limiting the pivotable motion of the rotary steerable system components with respect to each other via interaction of a removable strike ring and a corresponding strike ring; and employing a fastener system to removably couple the removable strike ring to one rotary steerable system component of the pair of rotary steerable system components to enable interchanging of removable strike rings for adjusting the limits of relative pivotable motion of the rotary steerable system components.

11. The method as recited in claim 10, further comprising:

providing the removable strike ring as a split strike ring;

removing the split strike ring; and attaching a different split strike ring which provides a different limit on the relative pivotable motion of the rotary steerable system components.

12. The method as recited in claim 10, wherein pivotably coupling comprises coupling the pair of rotary steerable system components to each other via a universal joint.

13. The method as recited in claim 10, wherein employing the fastener system comprises removably fastening separable components of the removable strike ring to one of the rotary steerable system components with a plurality of bolts.

14. The method as recited in claim 10, wherein employing the fastener system comprises removably fastening separable components of the removable strike ring to one of the rotary steerable system components with a spacer ring.

15. The method as recited in claim 14, further comprising releasing the spacer ring; interchanging the removable strike ring with a different removable strike ring without further strip-down of the rotary steerable system; and delivering the rotary steerable system downhole into a wellbore.

16. The method as recited in claim 10, further comprising coupling the rotary steerable system to a drill bit and deploying the rotary steerable system downhole for a drilling operation.

17. A method of adjusting a given dogleg capability of a drilling system, comprising:

unfastening a removable strike ring from a steerable drilling system having steering components which pivot relative to each other through a pivot angle limited by the removable strike ring; and interchanging the removable strike ring with a second removable strike ring having a configuration which allows a different pivot angle between the steering components of the steerable drilling system.

18. The method as recited in claim 17, wherein interchanging comprises fastening the second removable strike ring to one of the steering components at a position which allows the second removable strike ring to move against an abutment surface of a corresponding strike ring located on a different steering component.

19. The method as recited in claim 17, further comprising coupling the steering components to each other with a universal joint.

20. The method as recited in claim 17, further comprising using the steerable drilling system downhole for drilling a deviated wellbore.

* * * * *